United States Patent [19]

Okada

[11] Patent Number: 4,771,928

[45] Date of Patent: Sep. 20, 1988

[54] TOWEL FABRIC PROCESSING DEVICE

[76] Inventor: Takanori Okada, 1941, Minami-tahara-cho, Ikoma-shi, Nara-ken, Japan

[21] Appl. No.: 861,431

[22] Filed: May 9, 1986

[51] Int. Cl.[4] ..... B26D 7/14; B65H 23/18; D06C 3/06

[52] U.S. Cl. ..... 226/15; 26/51.3; 83/175

[58] Field of Search ..... 226/176, 15, 3; 83/175; 26/51.3, 51.4, 51.5

[56] References Cited

U.S. PATENT DOCUMENTS

| | | | |
|---|---|---|---|
| 3,182,536 | 5/1965 | Sumpter, Jr. et al. | 83/175 |
| 3,192,811 | 7/1965 | Simmons | 83/175 |
| 4,034,634 | 7/1977 | Arbter | 83/175 X |
| 4,261,498 | 4/1981 | Short | 226/3 |
| 4,368,837 | 1/1983 | Bodewein | 226/176 |
| 4,397,203 | 8/1983 | Brack et al. | 83/175 X |
| 4,493,234 | 1/1985 | Ziegler et al. | 83/175 |

*Primary Examiner*—Stuart S. Levy
*Assistant Examiner*—Lynn M. Sohacki
*Attorney, Agent, or Firm*—Joseph W. Farley

[57] ABSTRACT

A device for processing a towel fabric having thicker piled portions and thinner plain weave portions alternate with the piled portions longitudinally of the towel fabric, comprising lower rollers for supporting thereon the towel fabric, the lower rollers having a common axis extending widthwise of the towel fabric, upper rollers movable toward and away from the lower rollers and adapted to nip each plain weave portion of the towel fabric when the upper rollers are moved toward the lower rollers, the upper rollers having an common axis extending widthwise of the towel fabric, releasable stopper assembly for selectively preventing the upper rollers from moving away from the lower rollers, and a finger assembly for tensionally moving the towel fabric forward along a specified path through and between the upper and lower rollers.

4 Claims, 6 Drawing Sheets

TOWEL FABRIC PROCESSING DEVICE

BACKGROUND OF THE INVENTION

1. Field of the Invention

The present invention relates to a towel fabric processing device for use in a towel producing aparatus, and more particularly to an improved device for cutting a towel fabric to a specified length.

2. Description of the Prior Art

In producing towel fabrics by a towel producing apparatus, as shown in FIG. 7, a towel fabric 3 having long thick piled portions 1A, 1B, 1C alternate with short thin plain weave portions 2A, 2B, 2C is continuously formed.

To obtain a single length of towel the towel, fabric 3 thus made is withdrawn a predetermined length in the direction of arrow A in FIG. 7 and then the plain weave portion 2B is cut through the intermediate portion thoreof. However, the towel fabric 3 lacks stiffness and is soft, and its weft threads are not straight. Thus, in most cases, the boundary line 4 between the plain weave portion 2B and the piled portion 1B is curved. If the plain weave portion 2B is cut with the boundary line 4 remaining curved, in the subsequent triply-folding process there is the danger of the the portion intruding into the piled portion 1A to detract from commercial value.

Thus, it has been a common practice to lead the towel fabric onto a table, lower a straight bar onto it when the plain weave portion 2B comes therein to nip the portion 2B between the bar and the table, bring the curved boundary line 4 against the bar, and correct it into a straight line.

According to such a conventional arrangement, the curved boundary lines 4 could be corrected into straight lines by strongly pressing the bar. However, if the plain weave portion is pressed too strongly, the frictional resistance between the bar and the table would be excessively high, requiring a strong force to pull the towel fabric 3. Further, such strong tensile force can result in localized stretching of the towel fabric 3 which causes deflection or breakage, decreasing commercial value. On the other hand, if the pressing force of the bar is reduced, there is the danger of the boundary lines 4 passing through the bar because of the relatively small difference in level at each boundary line. Thus, it has been necessary to press the bar against the plain weave portion 2B with a moderate pressure, neither too strong nor too weak, so as to avoid such problems; However, this adjustment of pressure is very difficult.

SUMMARY OF THE INVENTION

The present invention provides a towel fabric processing device which has solved the aforesaid problems of prior art by requiring less force to pull a towel fabric while avoiding localized stretching of the towel fabric which causes deflection or breakage.

To achieve the aforesaid object, the invention provides a device for processing a towel fabric having thicker piled portions and thinner plain weave portions alternating with the piled portions longitudinally of the towel fabric, comprising lower roller means for supporting thereon the towel fabric, the lower roller means having an axis extending widthwise of the towel fabric, upper roller means movable toward and away from the lower roller means and adapted to nip each plain weave portion of the towel fabric when the upper roller means is moved toward the lower roller means, the upper roller means having an axis extending widthwise of the towel fabric, releasable stopper means for selectively preventing the upper roller means from moving away from the lower roller means, and means for tensionally moving the towel fabric forward along a specified path through and between the upper and lower roller means.

In the above arrangement, when the plain weave portion of the towel fabric comes between the lower and upper roller means, the upper roller means is pressed against the plain weave portion and then prevented by the stopper means from moving away from the plain weave portion. Then the projecting portions of a curved boundary line between the plain weave portion and the piled portion hit against the upper and lower roller means and are thereby prevented from moving forward; similarly, other portions of the line successively hit against the upper roller means and finally the most recessed portion hits against the roller means, whereupon the boundary line is straightened as a whole. Therefore, when the plain weave portions on the opposite ends of the towel blank are triply folded in the triply-folded process, there isno possibility of said triply-folded portions intrucing into piled portion, so that towels of high commercial value can be produced. Further, the use of roller means offers a reduced frictional resistance. Thus, only a small force is required to pull the towel fabric, meaning that there occurs no localized stretching of the towel fabric which causes deflection or breakage. In this respect, towels of high commercial value can be produced.

DESCRIPTION OF THE PREFERRED EMBODIMENTS

An embodiment of the invention will now be described with reference to FIGS. 1 through 6.

Figure 7:
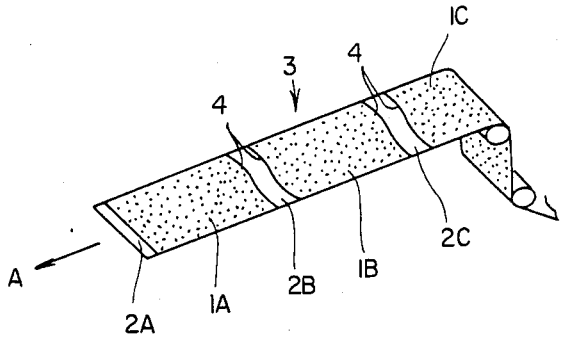
FIG. 7 is a perspective view of a towel fabric.

In the drwings, the numerals 6 and 7 denote a lower fixed cutter and an upper movable cutter, respectively, for vertically cutting the plain weave portions 2A, 2B, 2C (see FIG. 7) of a towel fabric 3, the movable cutter 7 being mounted at one end thereof to a shaft 8 for pivotal movement by a first air cylinder 9. Installed above a fixed table 10 positioned downstream from the two cutters 6 and 7 is a towel fabric withdrawing device including a finger assembly 11 for gripping the forward end of the towel fabric 3, and a carriage (not shown) movable in the directions of arrows A, B and supporting the finger assembly 11.

A main shaft 12 rotatably mounted at both ends thereof in fixed bearings 13 is disposed upstream from the two cutters 6 and 7. A pivotal frame 14 is connected to the shaft 12 by means of bearing brackets 15 fitted on the shaft 12 adjacent the bearings 13, the pivotal frame 14 being upwardly pivotable from its horizontal state. A first fabric guide roll 16 is fitted on the main shaft 12 intermediate its ends, and a second fabric guide roll 17 is installed below the first guide roll 16.

Rods 18 extend along the feed path of the towel fabric 3 and are suitably spaced transversely of the fabric feed path. Each rod 18 is supported at the opposite ends thereof by a front wall 14A and a rear wall 14B, respectively, projecting upwardly from the pivotal frame 14 and serves to support a sag in the towel fabric 3.

The upper end of the front wall 14A is formed with a support ledge 19 for supporting the towel fabric 3. The support ledge 19 is designed so that its upper surface is flush with the upper surface of the fixed table 10 when the pivotal frame 14 is pivoted down to the illustrated horizontal position.

A pair of guide rails 20 are laid on the bottom plate 14C of the pivotal frame 14 adjacent the opposite sides thereof and extend along the fabric feed path to slidably guide a slider 21 arranged on the pivotal frame 14. More specifically, the slider 21 comprises side bars 21A riding on the frame bottom plate 14C in sliding contact with the guide rails 20, a front wall 21B interposed between the front ends of the side bars 21A, a lateral wall 21C extending upward from each side bar 21A, and a top plate 21D disposed on the front and lateral walls 21B, 21C. The front wall 21B is formed with bores 22 for loose fit on the rods 18.

Each side bar **21*a* is formed with an insertion hole 23, while said bottom plate 14C is formed with a plurality of threaded holes 24 at suitable intervals along the fabric movement path. Thus, the slider 21 can be fixed at a selected position on the bottom plate 14C by a lock bolt 25 inserted into the insertion hole 23 and screwed into selected one of the threaded holes 24**.

A number of lower rollers 28 disposed at constant spacing are rotatably mounted on a support shaft 26 fixed at its opposite ends to brackets 27 disposed on the front wall 21B. The lower rollers 28 are so arranged as to partially project above the upper surface of the slider top plate 21D.

The support shaft 26 is supported by intermediate bearings 29 suitably spaced axially of the support shaft and bolted to the frame front wall 21B.

The lower ends of lateral plates 30 and 31 are bolted as at 32 to the slider lateral walls 21C, and a large diameter shaft 33 is fixed at its opposite ends to the lateral plates 30 and 31. The large diameter shaft 33 is provided with a number of pivotal plates 34 rotatably fitted thereon. Each pivotal plate 34 rotatably supports an upper roller 35 at the lower end thereof. Each upper roller 35 is disposed immediately above an associated one of the lower rollers 28, and the axes of the upper roller 35 and lower roller 28 extend widthwise of the towel fabric 3. The upper end of each pivotal plate 34 is formed with a hole 37 for reception of pivoting shaft 36 having its opposite ends positioned in large openings 38, 39 formed in the lateral plates 30 and 31. The numeral 40 denotes a release shaft arranged behind and parallel to the pivoting shaft 36.

A pair of first arms 41 are rotatably connected at their respective one ends to the opposite ends of the release shaft 40 and have elongated openings 42 for reception of slide rollers 43 mounted on the opposite ends of the pivoting shaft 36.

An operating shaft 44 is rotatably supported at its opposite ends by the lateral plates 30, 31. Each of second arms 45 is fixed at one end thereof to the operating shaft 44. The other end of the second arm 45 is rotatably connected to the release shaft 40. One end of a third arm 46 is fixed to the operating shaft 44. Pinned to the other end of the third arm 46 is the front end of a second air cylinder 47 whose body is rotatably pinned to an upper portion of the lateral plate 30.

Installed rearwardly of the pivotal plates 34 is a stop 48 fixed to the lateral plates 30 and 31. The surface of the stop 48 directed to the pivotal plates 34 is in the form of an inclined surface 49 which gradually approaches the pivotal plates 34 as it extends downward. The inclined surface 49 is opposed to the free ends of props 50 whose proximal ends are turnably pinned as at 51 respectively to the upper ends of the respective pivotal plates 34.

Installed above the pivotal plates 34 is a mount bar 52 fixed at its opposite ends to the lateral plates 30 and 31. There are provided plate springs 53 whose proximal ends are bolted to the mount bar 52, each plate spring 53 having a lower circular portion abutting against the associated one of the pivotal plates 34 so as to urge the corresponding upper roller 35 downward. The numeral 54 denotes a cover.

Installed above the ledge 19 is a hold bar 55 pivotable on a shaft 56. A third air cylinder, whose body is pinned to a piller 58 extending upward from the frame bottom plate 14C, has a piston rod rotatably connected at its lower end to the hold bar 55.

A fourth air cylinder 59 is installed below the front end of the pivotal frame 14 and has a piston rod which carries a push-up roller 60 opposed to the bottom plate 14C of the pivotal frame 14. The numeral 61 denotes a driving motor having a pulley 63 fixed on its driving shaft, with a belt 62 entrained around said puller 63 and around a pulley 64 fixed on the main shaft 12.

There is provided a height adjusting bolt (not shown) whose front end abuts against the bottom plate 14C of the pivotal frame 14 to define the lower limit position of the pivotal frame 14. A lever 66 is rotatably supported at its proximal end on an intermediate portion of the operating shaft 44 and carries a detecting roller 67 at its free end, the roller 67 being adapted to ride on the towel fabric 3 advancing on the slide top plate 21D. A proximity switch 68 is mounted on the lever 66 to detect the movement of the towel fabric 3 by detecting the rotation of the detecting roller 67.

Figure 1:
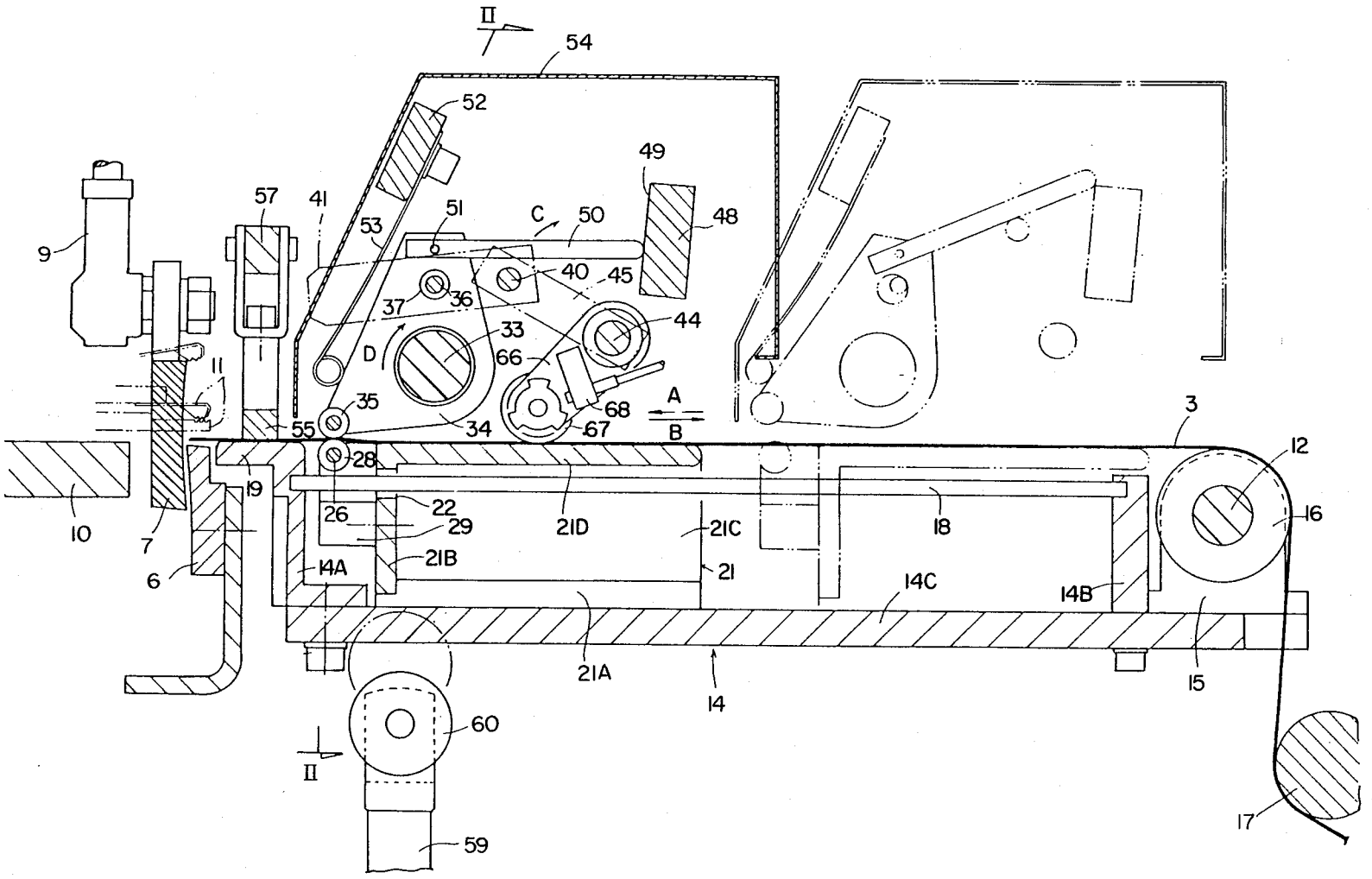
FIG. 1 is a vertical sectional view of a towel fabric processing device according to an embodiment of the present invention.
Figure 2:
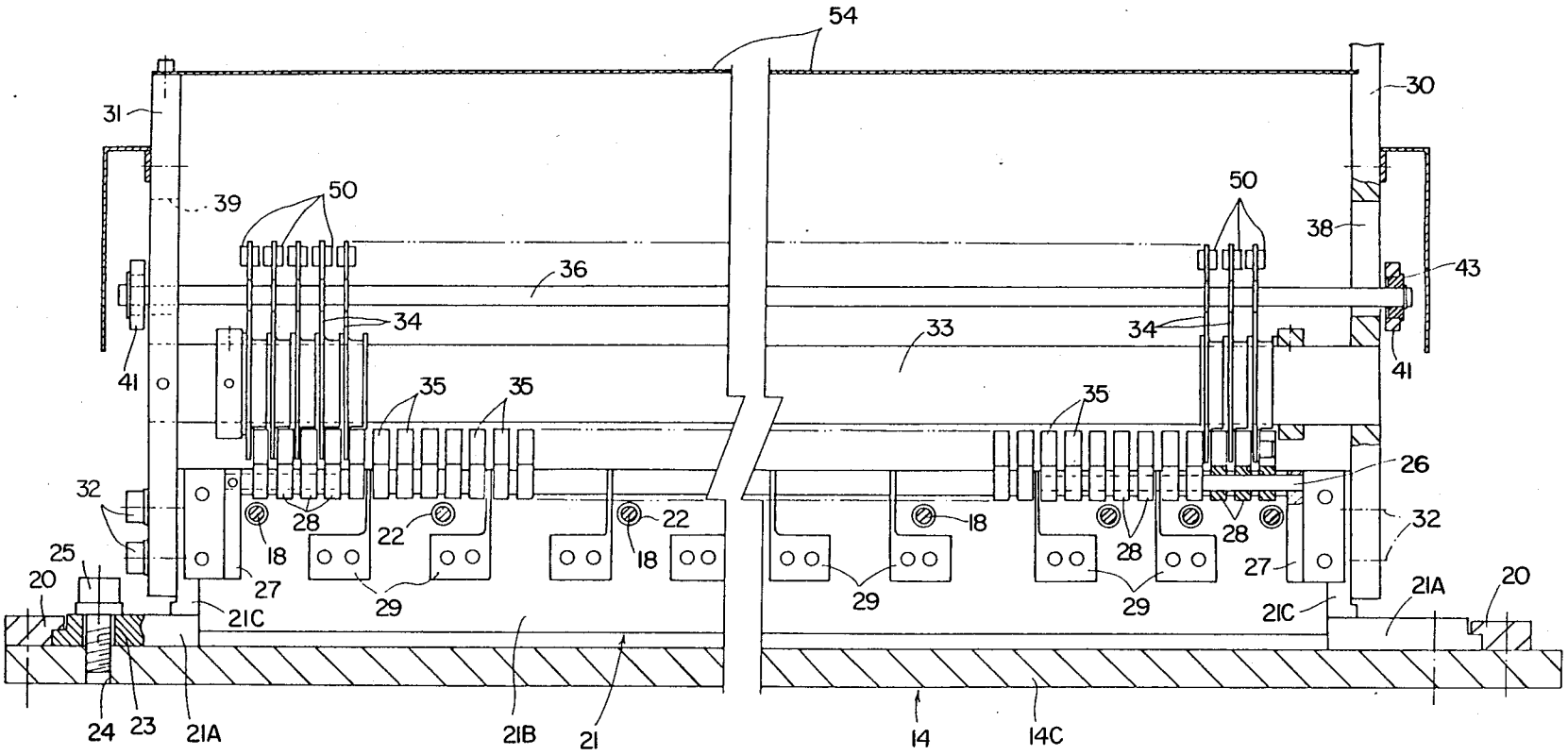
FIG. 2 is a view taken in the direction of arrow II—II in FIG. 1.
Figure 3:
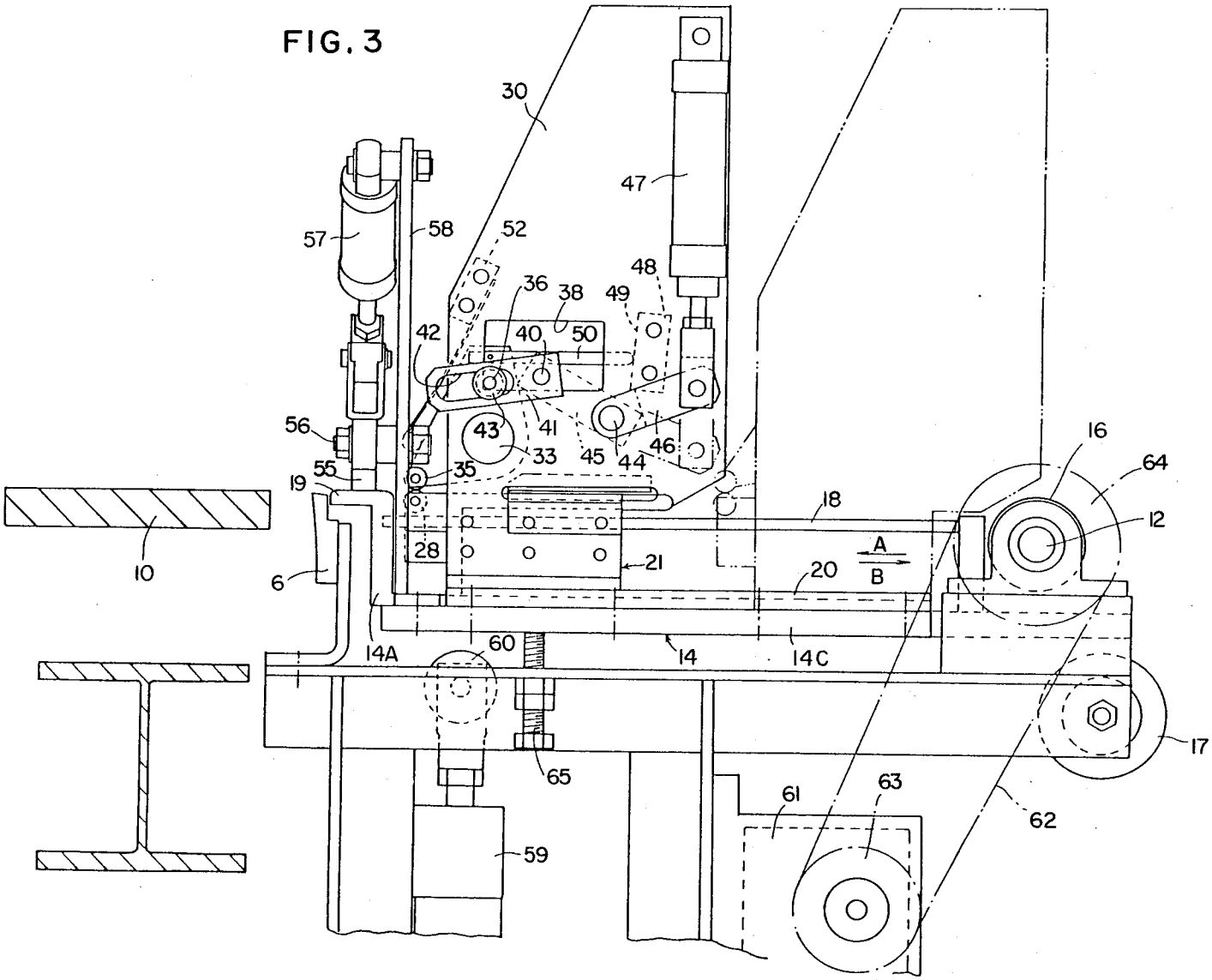
FIG. 3 is a side view of the towel fabric processing device according to said embodiment of the invention.
Figure 4:
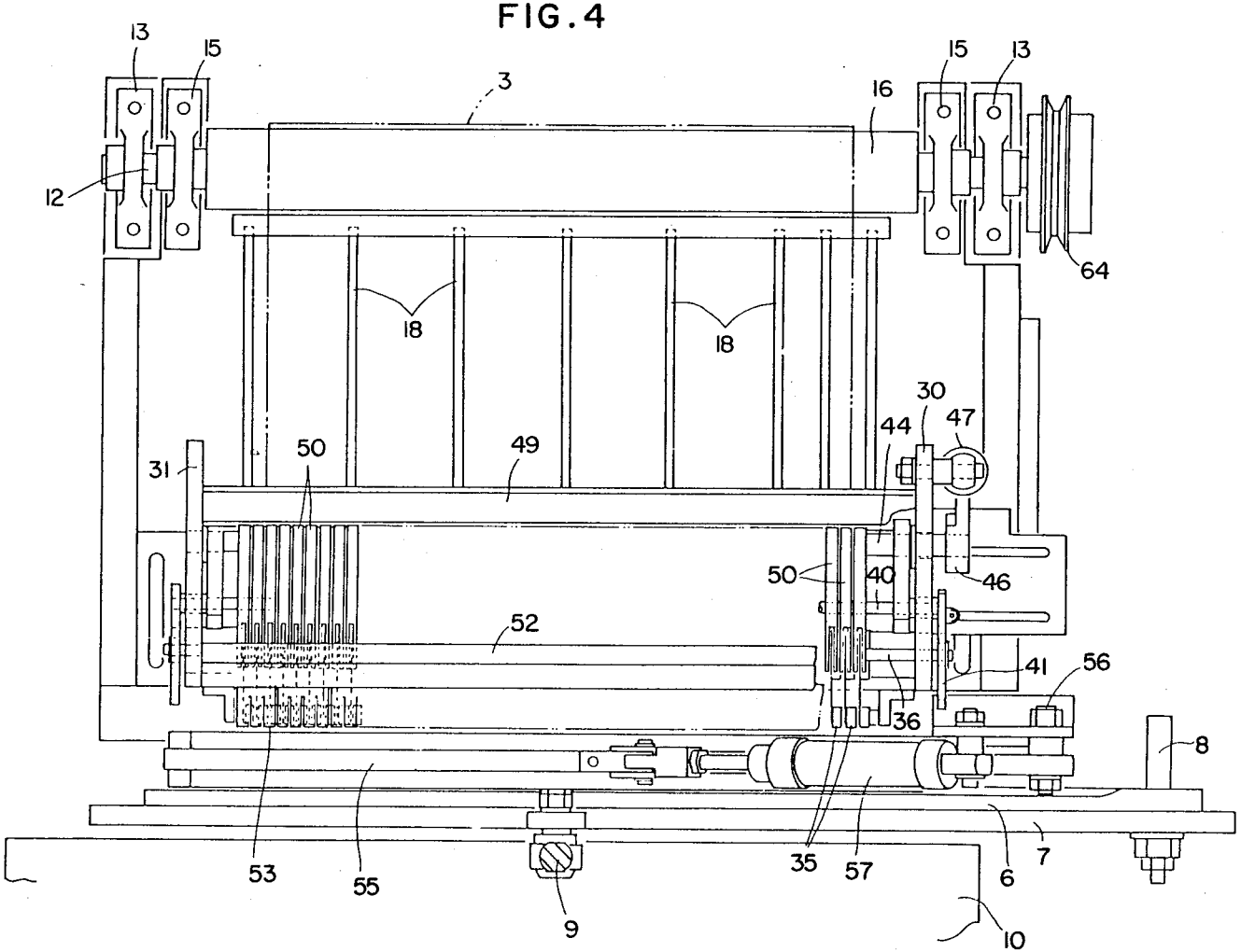
FIG. 4 is a plan view of the towel fabric processing device shown with its cover removed.
Figure 5A:
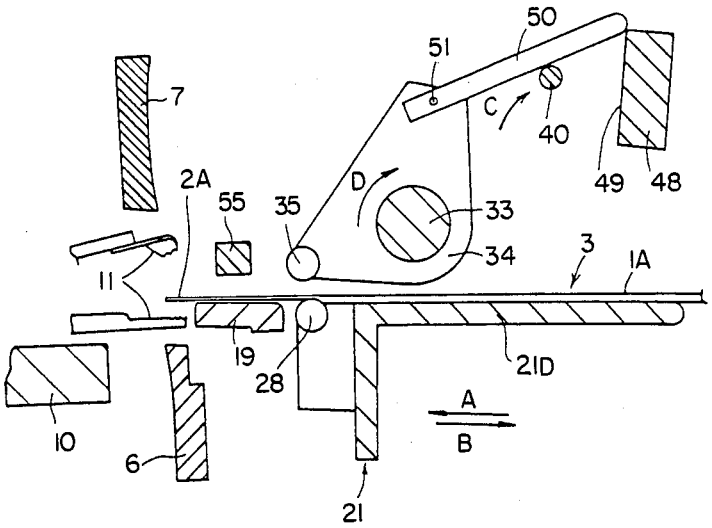
FIGS. 5*a* and 5*b* are schematic vertical lateral sectional views showing the operating procedure of the towel processing device.
Figure 5B:
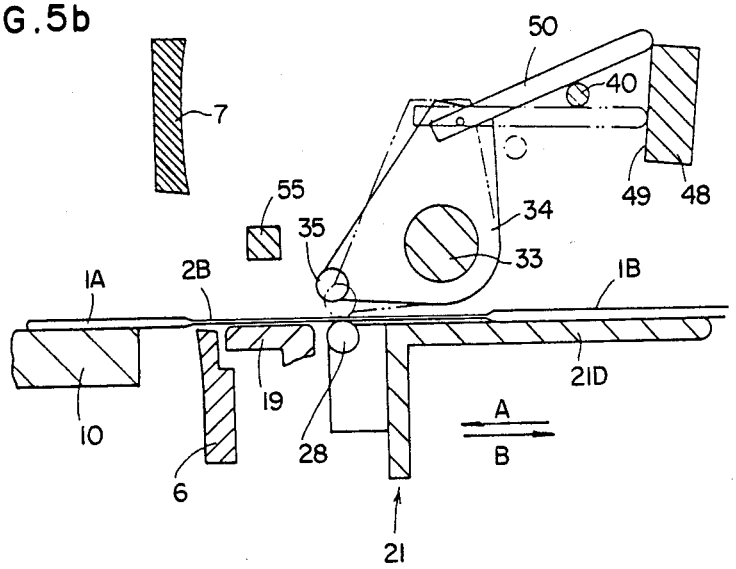
Figure 6:
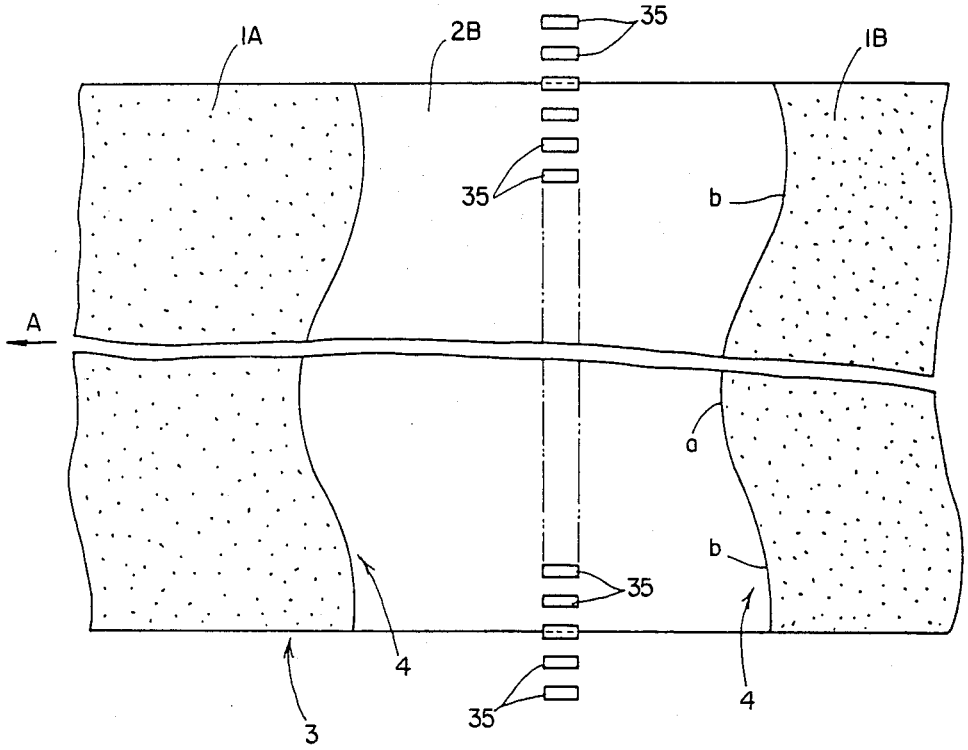
FIG. 6 is a schematic plan view showing the procedure of straightening a plain weave portion by the towel processing device.

The operation of the above arrangement will now be described. The state shown in solid line in FIG. 1 is one in which the plain weave portion 2A of the towel fabric 3 has been cut by the cutters 6, 7. when the towel fabric 3 is further drawn from this state in the direction of arrow A, the movable cutter 7 and the hold bar 55 are raised by the first and third air cylinders 9, 57 as shown in FIG. **5*a*, and the piston of the second air cylinder 47 is extended (as shown in phantom lines in FIG. 3) to raise the release shaft 40 in the direction of arrow C through the intermediary of the third arm 46, the operating shaft 44 and the second arm 45, whereby the release shaft 40 lifts the front ends of the props 50, thus cancelling the state in which the front ends of the props 50 abut against the inclined surface 49. Then, with some delay, one end of the elongated opening 42 in each first arm 41 abuts against the associated slide roller 43 to pivot up the pivotal plates 34 on the large diameter shaft 33 in the direction of arrow D, thereby raising the upper rollers 35 against the force of the plate springs 53. Further, the piston rod of the fourth air cylinder 59 is extended to press the push-up roller 60 agaisnt the pivotal frame 14. Thereby, the pivotal frame 14 is pivoted upward on the main shaft 12 to raise the forward end of the towel fabric 3 to a gripping position. Then, the towel withdrawing device on the fixed table 10 is moved in the direction of arrow B to bring the finger assembly 11 in an open state to a location suitable for gripping the forward end of the towel fabric 3. The finger assembly 11 is then caused to grip the forward end of the towel fabric 3, whereupon the towel withdrawing device is moved in the direction of arrow A. The piston rod of the fourth air cylinder 59 is then retracted to lower the pivotal frame 14. FIG. 5*b* shows a state in which the towel fabric 3 has been withdrawn a predetermined length by the towel fabric withdrawing device. The completion of withdrawal by the predetermined length of the towel fabric 3 is detected by the detector 68 which then produces a detection signal to retract the piston rod of the second air cylinder 47. Thereupon, the pivotal plates 34 are pivoted downward by the forces of the plate springs 53, with the result that the upper rollers 35 contact the following plain weave portion 2B to cooperate with the lower rollers 28 to hold the plain weave portion 2B therebetween. Further, the downward movement of the actuating shaft 40 lowers the props 50 until their free ends contact the stopper inclined surface 49 as shown in phantom lines in FIG. 5*b* and in solid lines in FIG. 1. Then, the towel fabric 3 is pulled further in the direction of arrow A, whereby the rollers 28, 35 are rotated, allowing the plain portion 2B of the towel fabric 3 to pass smoothly between the roller pairs 28, 35 without being subjected to much frictional resistance. In FIG. 6, the projecting portion a of the boundary line 4 between the plain weave portion 2B and the following piled portion 1B first contacts the rollers 28, 35. At this moment, the corresponding upper roller or rollers 35 are subjected to an upward reaction, but since this reaction is resisted by the corresponding prop or props 50, there is no possibility of said upper roller or rollers moving upward; thus, the forward movement of said projecting portion a is prevented without failure. Similary, other portions of the boundary line 4 successively contact the rollers 28, 35 until the recessed portions b contact the rollers 28, 35, with the result that the boundary line 4 is straightened. When the boundary line 4 has been straightened in this manner, the flow of the towel fabric 3 is stopped, which stoppage is detected by the proximity switch 68 which then produces a detection signal to actuate the third air cylinder 57 to lower the hold bar 55, the latter cooperating with the ledge 19 to hold the towel fabric 3 therebetween. Subsequently, the first air cylinder 9 is actuated to lower the movable cutter 7, so that the latter cooperates with the fixed cutter 6 to cut the plain weave portion 2B substantially at the middle thereof (as shown in solid lines in FIG. 1). The towel blank thus cut is then transferred to the known triply folding unit (not shown), where the plain weave portions 2A, 2B** at its opposite ends are each triply folded and the resulting triply folded portions are each sewn.

The aforesaid inclined surface 49 of the stop 48 may be a vertical surface.

In FIG. 1, the slider 21 and its related parts are shown in both solid and phantom lines to indicate that the slider 21 is selectively lockable at a desired position along the fabric withdrawl path depending on the length of the plain weave portions of the towel fabric 3.

What is claimed is:

1. A device for processing a towel fabric having thicker piled portions and thinner plain weave portions alternating with the piled portions longitudinally of the towel fabric, comprising means for tensionally moving the towel fabric forward along a specified path, a plurality of lower rollers spaced transversely of the fabric moving path for supporing thereon the towel fabric, a plaurality of separate pivotal plates spaced transversely of the fabric moving path in a position located above the fabric moving path, the pivotal plates being pivotable upward and downward all together, a plurality of upper rollers rotatably mounted on the respective lower ends of the pivotal plates and movable toward and away from the lower rollers according to the pivoting motion of the pivotal plates, the upper rollers being adapted to nip each plain weave portion of the towel fabric when moved toward the lower rollers, spring means for urging the pivotal plates in the direction of contact of the upper rollers with the lower rollers, releasable stopper means for selectively preventing the pivotal plates from pivoting upward to move the upper rollers away from the lower rollers, when the upper and lower rollers nip the plain weave portions, whereby the piled portions hit against the upper and lower rollers and prevent the towel fabric from moving forward, means for detecting the movment and the stoppage of the towel fabric, and means for releasing the stopper means and making the pivotal plates pivot upward to move the upper rollers away from the lower rollers to allow the towel fabric to move forward when the stoppage of the towel fabric is detected by the detecting means.

2. A device as defined in claim 1, wherein the stopper means comprises props each pivotally connected at one end thereof to a respective one of said pivotal plates, a stop bar adapted to contact the other ends of the props, and said means for releasing the stopper means comprises a release shaft adapted to raise the props out of contact with the stop bar, and a pivoting shaft adapted to pivot the pivotal plates upward.

3. A device as defined in claim 2, wherein the lower rollers are rotatably mounted on a shaft supported in brackets on a slider which is movable back and forth along the fabric moving path depending on the length of the plain weave portions, and the upper rollers and the stopper means are mounted on the slider.

4. A device for processing a towel fabric having thicker piled portions and thinner plain weave portions alternating with the piled portions longitudinally of the towel fabric, comprising withdrawing means for tensionally moving the towel fabric forward along a specified path;

a plurality of lower rollers spaced transversely of the fabric moving path for supporting thereon the towel fabric;

a plurality of separate pivotal plates spaced transversely of the fabric moving path in a position located above the fabric moving path, the pivotal plates being pivotable upward and downward all together;

a plurality of upper rollers rotatably mounted on the respective lower ends of the pivotal plates and movable toward and away from the lower rollers according to the pivoting motion of the pivotal plates, means for pivoting said pivotal plates downwardly in response to forward movement of a predetermined length of the towel fabric whereby each plain weave portion thereof is nipped between said upper and lower rollers, spring means for urging each of the pivotal plates in the downward direction, and releasable stopper means for selectively preventing the pivotal plates from pivoting upward to move the upper rollers away from the lower rollers, whereby said upper and lower rollers are adapted to be progressively contacted by the piled portion of the towel fabric following the plain portion thereof nipped therebetween, stopping forward movement of the towel fabric with the boundary between said nipped plain portion and following portion in a transversely straight condition.

* * * * *

UNITED STATES PATENT AND TRADEMARK OFFICE

CERTIFICATE OF CORRECTION

PATENT NO. : 4,771,928

DATED : September 20, 1988

INVENTOR(S) : Takanori Okada

It is certified that error appears in the above—identified patent and that said Letters Patent is hereby corrected as shown below:

Column 2, line 22, "isno" should read --is no--

Column 2, line 55, "drwings" should read --drawings--

Column 4, line 29, "piller" should read --pillar--

Column 5, line 3, "agaisnt" should read --against--

Column 6, line 13, "plaurality" should read --plurality--

Signed and Sealed this

Fourteenth Day of February, 1989

*Attest:*

DONALD J. QUIGG

*Attesting Officer*

*Commissioner of Patents and Trademarks*